US007010944B1

(12) United States Patent
Chiu

(10) Patent No.: US 7,010,944 B1
(45) Date of Patent: Mar. 14, 2006

(54) PADLOCK HAVING RESTORING MECHANISM

(76) Inventor: Chien Chih Chiu, No. 18, Lane 121, Sec. 4, Jiyiu Road, East Dist., Taichung 401 (TW)

( * ) Notice: Subject to any disclaimer, the term of this patent is extended or adjusted under 35 U.S.C. 154(b) by 0 days.

(21) Appl. No.: 10/998,376

(22) Filed: Nov. 29, 2004

(51) Int. Cl.
*E05B 37/18* (2006.01)

(52) U.S. Cl. ..... 70/26; 70/298; 70/299; 70/313

(58) Field of Classification Search ..... 70/25, 70/26, 29, DIG. 9, 289, 290, 296–300, 313, 70/314
See application file for complete search history.

(56) References Cited

U.S. PATENT DOCUMENTS

| | | | | | |
|---|---|---|---|---|---|
| 870,890 | A | * | 11/1907 | Kruse | 70/29 |
| 992,400 | A | * | 5/1911 | Blakesley | 70/29 |
| 1,293,879 | A | * | 2/1919 | Neumann | 70/29 |
| 1,895,655 | A | | 1/1933 | Fraim | |
| 2,132,201 | A | * | 10/1938 | Allman | 70/25 |
| 2,628,490 | A | * | 2/1953 | Klein | 70/25 |
| 2,928,271 | A | * | 3/1960 | Watson | 70/25 |
| 4,111,014 | A | * | 9/1978 | Epstein | 70/25 |
| 4,196,603 | A | * | 4/1980 | Malacheski et al. | 70/313 |
| 4,476,698 | A | * | 10/1984 | Treslo | 70/25 |
| 4,709,564 | A | * | 12/1987 | Minami | 70/25 |
| 4,751,830 | A | * | 6/1988 | Cheng | 70/25 |
| 4,811,578 | A | | 3/1989 | Masoncup et al. | 70/38 B |
| 4,866,958 | A | * | 9/1989 | Bretl et al. | 70/25 |
| 5,540,065 | A | | 7/1996 | Wyers | 70/26 |

* cited by examiner

*Primary Examiner*—Lloyd A. Gall
(74) *Attorney, Agent, or Firm*—Charles E. Baxley

(57) ABSTRACT

A padlock includes a shackle attached to a lock housing, a lever pivotally disposed in the lock housing and having one end for anchoring legs of the shackle to the lock housing, a carrier slidably received in the lock housing and having an actuating member to selectively disengage the lever from the legs of the shackle and having a number of protrusions. A follower is slidably attached onto the lock housing, and includes an anchoring device to anchor the carrier to the lock housing at selected positions. An operating device includes a number of selected bars slidably attached onto the lock housing, to actuate the protrusions of the carrier, and to move the carrier relative to the lock housing step by step.

14 Claims, 8 Drawing Sheets

PADLOCK HAVING RESTORING MECHANISM

BACKGROUND OF THE INVENTION

1. Field of the Invention

The present invention relates to a padlock, and more particularly to a padlock having a restoring mechanism to restore a lock device back to original or initial status, and to prevent the padlock from being easily and quickly unlocked by unauthorized persons.

2. Description of the Prior Art

Various kinds of typical padlocks have been widely developed and used for a long time, and comprise a lock device disposed in a lock housing, and a latch biased to engage with a shackle and to lock the shackle to the lock housing. The latch may be disengaged from the shackle when the lock device is unlocked with a predetermined key.

For example, U.S. Pat. No. 1,895,655 to Fraim discloses one of the typical padlocks and also comprises a latch biased to engage with a shackle and to lock the shackle to the lock housing, and also disengageable from the shackle when the lock device is unlocked with a predetermined key. Fraim discloses a most conventional padlock device.

U.S. Pat. No. 4,811,578 to Masoncup et al. discloses another typical padlock comprising a latch biased to engage with a shackle and to lock the shackle to the lock housing, and further comprising an alarm that may be actuated in response to the momentary closing of a switch when one shackle leg moves outwardly upon severance or forcible opening.

U.S. Pat. No. 5,540,065 to Wyers discloses a further typical combination lock means comprising a resettable combination inner assembly allowing for the setting of any combination by its user for convenient locking or removal without the need for additional tools or keys. In addition, the lock device further includes a series of outer projections provided on its exterior for its locking and unlocking without the benefit of visual confirmation. However, the typical combination lock means do not have any restoring mechanism to restore the lock device back to the original or initial status, and to increase unlocking time for the lock device by unauthorized persons.

The present invention has arisen to mitigate and/or obviate the afore-described disadvantages of the conventional padlocks.

SUMMARY OF THE INVENTION

The primary objective of the present invention is to provide a padlock including a restoring mechanism to restore a lock device back to original or initial status, and to prevent the padlock from being easily and quickly unlocked by unauthorized persons.

In accordance with one aspect of the invention, there is provided a padlock comprising a lock housing including a chamber formed therein, and including two longitudinal channels formed in side portions thereof, a shackle including two legs slidably engageable into the channels of the lock housing respectively, and each having a notch formed therein, a lever pivotally disposed in the lock housing with a pivot pin, and including a first end for engaging into the notch of either of the legs of the shackle, to anchor the legs of the shackle to the lock housing, and including a second end, a carrier slidably received in the chamber of the lock housing, and including an actuating member provided thereon, for selectively engaging with the second end of the lever, and for rotating the lever relative to the lock housing, to disengage the first end of the lever from the notch of the legs of the shackle, and to allow the legs of the shackle to be disengaged from the lock housing, the carrier including a number of protrusions extended therefrom, a spring biasing device for biasing the actuating member of the carrier away from the second end of the lever, a follower slidably attached onto the lock housing, and including an anchoring device for engaging with the carrier, and for positioning and anchoring the carrier to the lock housing at selected positions, an operating device including a number of selected bars and non-selected bars slidably attached onto the lock housing, the selected bars being arranged to engage with and to actuate the protrusions of the carrier, in order to move the carrier relative to the lock housing step by step, and the non-selected bars being arranged to engage with and to actuate the follower, to selectively disengage the anchoring device of the follower away from the carrier, and to allow the actuating member of the carrier to be biased away from the second end of the lever by the spring biasing device.

The selected bars each includes an actuating end for engaging with the protrusions of the carrier, and for moving the carrier relative to the lock housing, and another end offset from the follower, to prevent the follower from being actuated by the selected bars.

The non-selected bars are extended inwardly within a range of the follower, to allow the follower to be moved relative to the lock housing and the carrier by either of the non-selected bars, the non-selected bars are offset from the protrusions of the carrier, to prevent the protrusions of the carrier from being actuated by the non-selected bars.

The lock housing includes a number of posts extended therefrom, the selected bars and the non-selected bars are slidably attached onto the posts of the lock housing. The lock housing includes a number of spring elements engaged onto the posts respectively, and engaged with the selected bars and the non-selected bars respectively, for biasing the selected bars and the non-selected bars away from the carrier and the follower respectively. The carrier includes a number of grooves formed therein, to slidably receive the posts, and to allow the carrier to be moved relative to the lock housing.

The lock housing includes at least one rod extended therefrom, the follower is slidably attached onto the rod of the lock housing, and movable toward and away from the carrier. The lock housing includes at least one spring element engaged with the rod, and engaged with the follower, for biasing the follower away from the carrier.

The lever includes device for forcing the first end thereof to engage into the notch of either of the legs of the shackle. The carrier includes a recess formed therein, and located to receive the second end of the lever, and the actuating member is arranged in the recess of the carrier.

The lock housing includes two end portions, the spring biasing device includes at least two spring members disposed in the end portions of the lock housing, and engaged with the carrier, to bias and to resiliently move the carrier within the chamber of the lock housing.

The carrier includes a space formed therein and defined between two side flanges each of which includes a number of depressions formed therein and defined between bulges, the anchoring device of the follower includes at least one tongue extended therefrom for engaging with the depressions of the carrier, and for anchoring the carrier to the follower and thus to the lock housing, and the tongue of the anchoring device is disengageable from the depressions of the carrier when the follower is moved relative to the carrier.

The lock housing includes a number of spring-biased buttons disposed therein, and each arranged in line with the selected bars and the non-selected bars respectively, for actuating the selected bars and the non-selected bars toward the carrier and the follower respectively. The lock housing includes two tubular members provided therein to define the longitudinal channels thereof, and to slidably receive the legs of the shackle therein respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
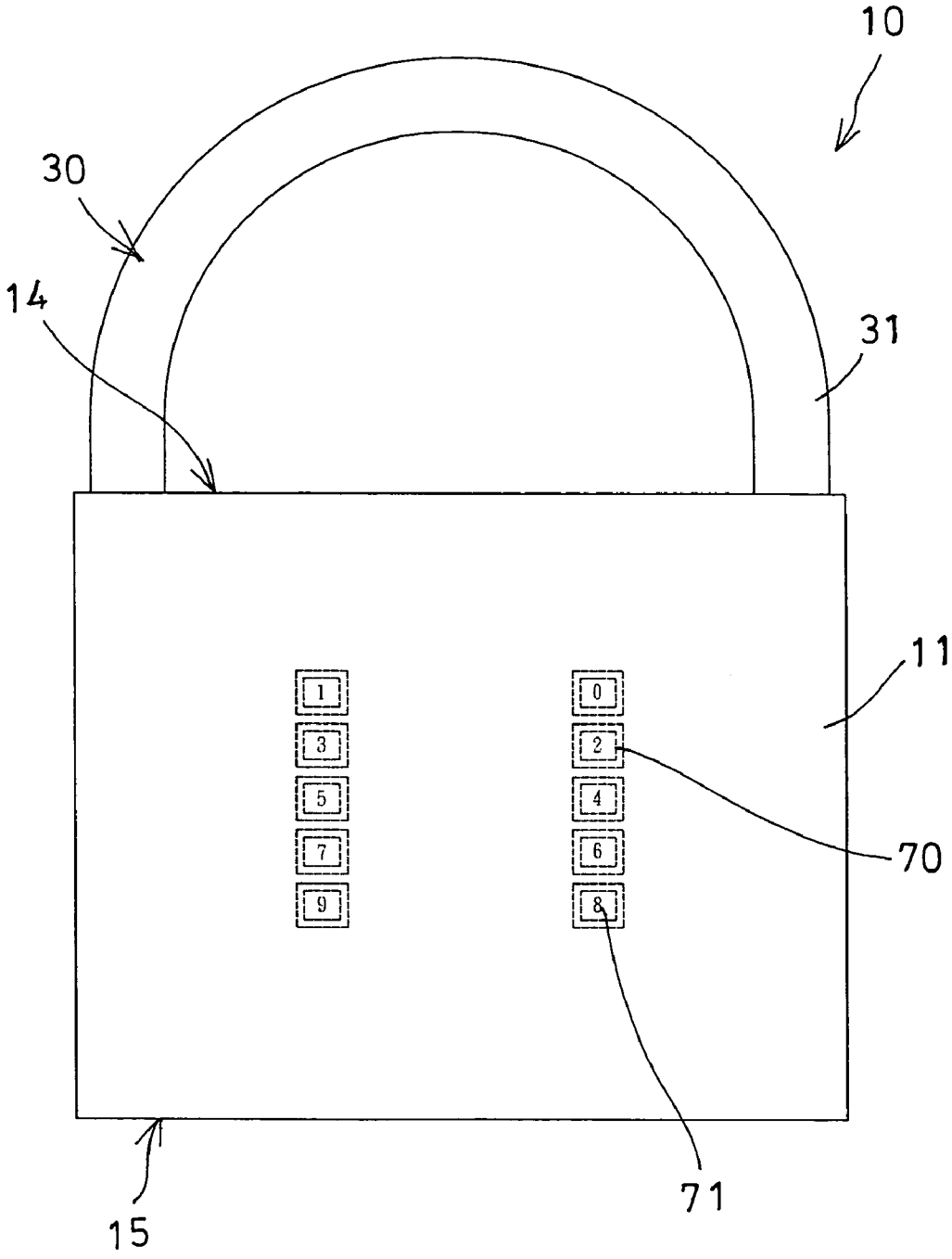
FIG. 1 is a top plan view of a padlock in accordance with the present invention.
Figure 3:
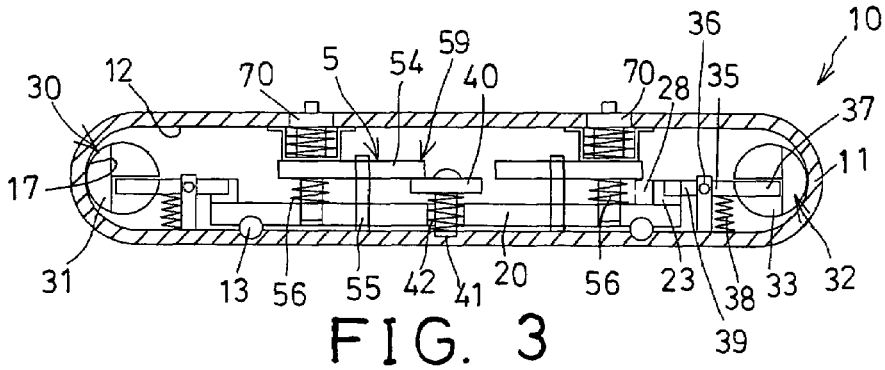
FIG. 3 is a partial cross sectional view of the padlock, taken along lines 3—3 of FIG. 2.
Figure 2:
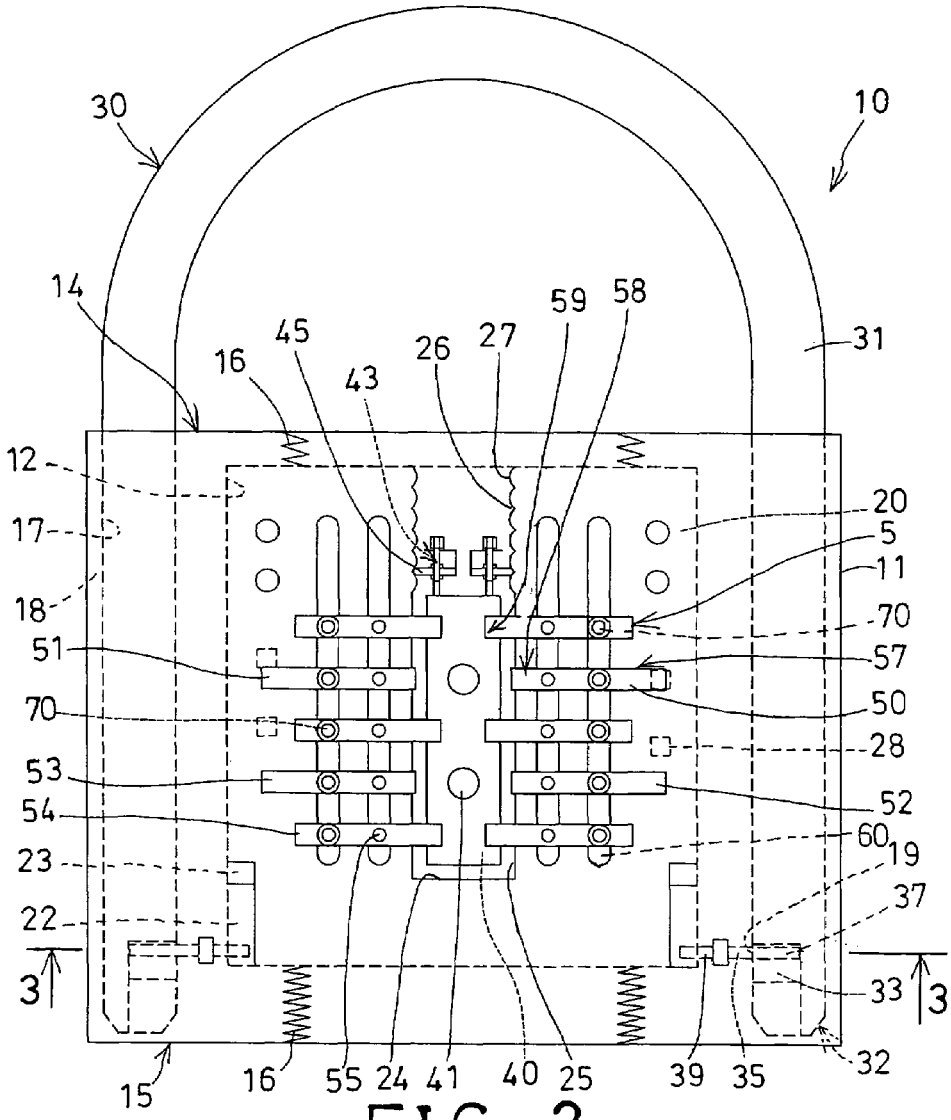
FIG. 2 is a top plan view similar to FIG. 1, in which a lock housing is partially cut or hidden or concealed to show an inner structure of the padlock.

Referring to the drawings, and initially to FIGS. 1–3, a padlock 10 in accordance with the present invention comprises a lock housing 11 including a chamber 12 formed therein (FIGS. 3, 8–9), for slidably receiving a carrier 20 therein. For example, the carrier 20 may be slidably received in the lower portion of the chamber 12 of the lock housing 11 with ball bearing devices 21, to allow the carrier 20 to be smoothly slid within the chamber 12 of the lock housing 11.

The lock housing 11 includes one or more spring members 16 disposed in either or both of two end portions 14, 15 thereof, and engaged with the carrier 20, to bias the carrier 20 toward a predetermined intermediate location or position within the chamber 12 of the lock housing 11, and thus to allow the carrier 20 to resiliently slide and move within the chamber 12 of the lock housing 11, toward either or both end portions 14, 15 of the lock housing 11. The spring biasing forces of the spring members 16 may be arranged to move the carrier 20 to the predetermined or required location or position within the chamber 12 of the lock housing 11, which will be discussed hereinafter.

The lock housing 11 further includes two longitudinal channels 17 formed in side portions thereof, and each formed or defined by a tubular member 18, for slidably receiving a leg 31 of a shackle 30 therein respectively. Each of the legs 31 of the shackle 30 includes a free end portion 32 having a notch 33 formed therein and facing inwardly or facing toward each other. It is preferable that each tubular member 18 of the lock housing 11 includes a hole 19 formed therein, and aligned with or communicating with the notch 33 of the corresponding legs 31 of the shackle 30.

One or more, such as two levers 35 are each rotatably or pivotally disposed in the lock housing 11 with a pivot pin 36, and each includes one end or outer end 37 for engaging into the notch 33 of the legs 31 of the shackle 30 via such as the holes 19 of the tubular members 18, in order to engage with and to anchor or to latch the legs 31 of the shackle 30, and thus to prevent the legs 31 of the shackle 30 from being disengaged from the lock housing 11 before the ends 37 of the levers 35 are disengaged from the notches 33 of the legs 31 of the shackle 30.

The lock housing 11 further includes one or more, such as two spring elements 38 disposed therein, and engaged with the levers 35 respectively, to bias the ends 37 of the levers 35 to engage into the corresponding notches 33 of the legs 31 of the shackle 30. The levers 35 each includes another end or inner end 39 located within the chamber 12 of the lock housing 11, for engaging with the carrier 20, and for being actuated or operated by the carrier 20.

For example, the carrier 20 includes one or more, such as two recesses 22 formed therein, and located on side portions for receiving the inner ends 39 of the levers 35 respectively, and a ramp or actuating member 23 formed or provided therein, such as arranged in each of the recesses 22 thereof, for selectively engaging with the inner ends 39 of the levers 35 respectively, and for rotating the levers 35 relative to the lock housing 11 about the pivot pin 36 respectively (FIG. 9), and thus for disengaging the outer ends 37 of the levers 35 from the notches 33 of the legs 31 of the shackle 30, and thus for allowing the legs 31 of the shackle 30 to be disengaged or moved out of the channels 17 of the lock housing 11. The spring members 16 may be used to move the actuating member 23 of the carrier 20 away from the inner ends 39 of the levers 35.

Figure 9:
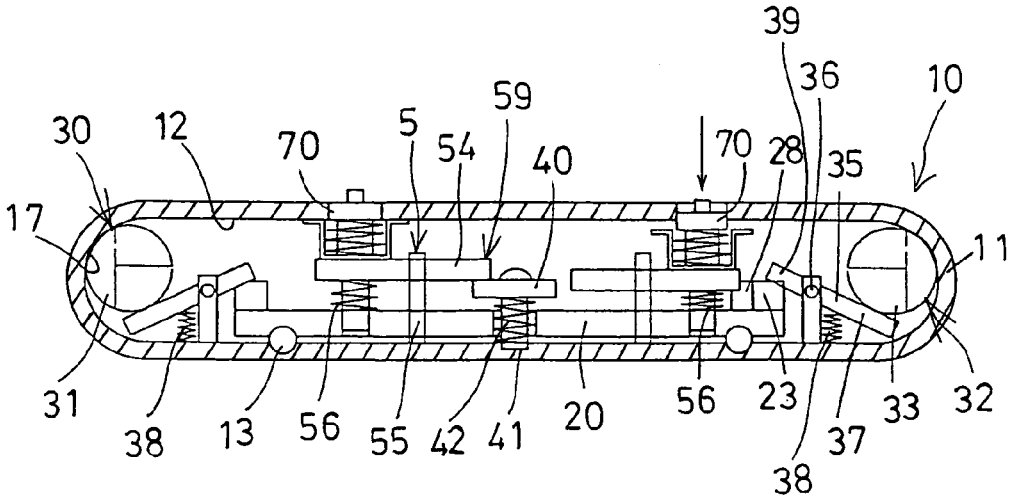

As shown in FIGS. 2 and 5–7, the carrier 20 includes a longitudinal space 24 formed therein, and defined between two side flanges 25 each having a number of depressions 26 formed therein and defined between bulges 27. A follower 40 is slidably attached onto the lock housing 11 with rods 41. For example, the lock housing 11 includes one or more rods 41 extended therefrom, and the follower 40 is slidably attached onto the rods 41 of the lock housing 11, and movable toward and away from the carrier 20, and one or more spring members 42 are disposed between the follower 40 and the lock housing 11, such as engaged onto the rods 41 respectively, to bias or to move the follower 40 away from the carrier 20 (FIGS. 3, 9).

Figure 8:
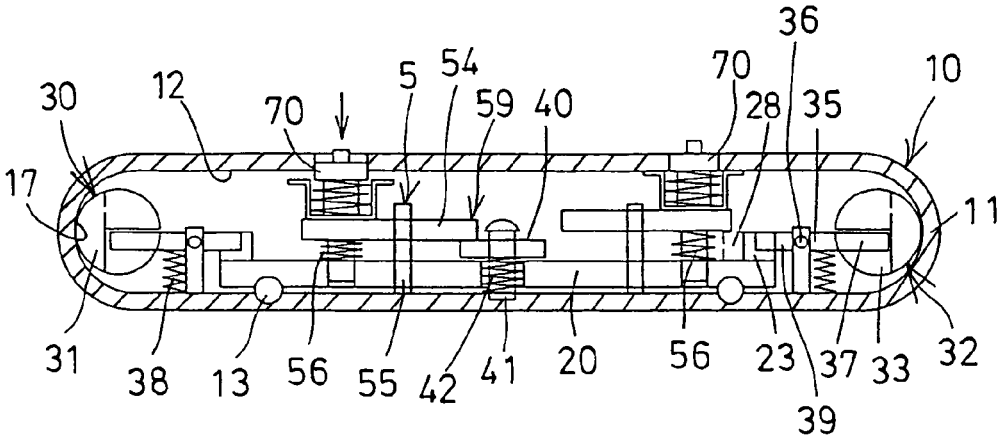
FIGS. 8, 9 are partial cross sectional views similar to FIG. 3, illustrating the operation of the padlock.

The follower 40 includes one or more, such as two positioning or anchoring devices 43 attached thereto, or extended therefrom, and each having a spring-biased tongue 45 laterally extended therefrom, for engaging into the depressions 26 of the carrier 20, and for positioning or anchoring the carrier 20 to the lock housing 11 at selected or predetermined position. The spring-biased tongues 45 of the anchoring devices 43 are arranged to be disengaged from the depressions 26 of the carrier 20 when the follower 40 is moved or forced toward the carrier 20 (FIG. 8).

It is to be noted that the follower 40 is no longer anchored or secured to the carrier 20 when the spring-biased tongues 45 of the anchoring devices 43 are disengaged from the depressions 26 of the carrier 20, such that the carrier 20 may be biased or moved or recovered or restored toward the predetermined or required location or position within the chamber 12 of the lock housing 11 again by the spring members 16 at this moment.

An operating device 5 includes a number of bars 50, 51, 52, 53, 54, such as ten bars 50, 51, 52, 53, 54 each slidably attached onto the lock housing 11 with one or more posts 55.

For example, the lock housing 11 includes ten or more posts 55 extended therefrom, and the bars 53 are slidably attached onto the posts 55 of the lock housing 11 respectively, and movable toward and away from the carrier 20 or the follower 40, and ten or more spring elements 56 are disposed between the follower 40 and the bars 50, 51, 52, 53, 54 respectively, and preferably disposed between the lock housing 11 and the bars 50, 51, 52, 53, 54 respectively, such as engaged onto the posts 55 respectively, to bias or to move the bars 50, 51, 52, 53, 54 away from the carrier 20 and the follower 40 respectively (FIGS. 3, 9).

Figure 4:
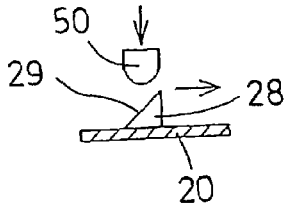
FIG. 4 is an enlarged partial cross sectional view illustrating the operation of the padlock.

The carrier 20 further includes one or more protrusions 28 extended therefrom, and each having an inclined surface 29 formed thereon (FIG. 4), for engaging with the bars 50, 51, 52, 53 respectively, and thus for allowing the carrier 20 to be moved relative to the lock housing 11 by the bars 50, 51, 52, 53 and the protrusions 28 of the carrier 20. The carrier 20 further includes one or more, such as four grooves 60 formed therein, to slidably receive the posts 55, and thus to allow the carrier 20 to be moved relative to the lock housing 11 without being interfered by the posts 55 and the operating device 5.

One or more, such as four selected bars 50, 51, 52, 53 each includes an actuating end 57 extended therefrom, for engaging with the protrusions 28 of the carrier 20, and for moving the carrier 20 relative to the lock housing 11. It is to be noted that the selected bars 50, 51, 52, 53 each includes another end 58 offset from the follower 40, to prevent the follower 40 from being depressed or actuated by the selected bars 50, 51, 52, 53.

The other non-selected bars 54 each includes one end 59 extended inwardly within the area or the range of the follower 40, for allowing the follower 40 to be depressed and moved relative to the lock housing 11 and the carrier 20 by either of the non-selected bars 54 (FIG. 8). The other non-selected bars 54 are offset from the protrusions 28 of the carrier 20, to prevent the protrusions 28 of the carrier 20 from being depressed or actuated by the non-selected bars 54.

The lock housing 11 includes a number of spring-biased buttons 70 disposed therein, such as ten spring-biased buttons 70 disposed therein, and each arranged above or in line with the corresponding bars 50, 51, 52, 53, 54, for depressing or actuating the bars 50, 51, 52, 53, 54 toward the carrier 20 and the follower 40 respectively. Each of the spring-biased buttons 70 includes a numeral or an indicium 71 provided thereon.

In operation, as shown in FIGS. 2 and 5–7, the protrusions 28 are provided on or extended from the carrier 20, and arranged or located to be actuated or operated or moved by the selected bars 50, 51, 52, 53 in series. For example, as shown in FIG. 2, when the selected bar 50 of the selected indicium or numeral "2", for example, of the selected button 70 is first depressed by the user, the selected bar 50 may actuate the selected protrusion 28 to move the carrier 20 relative to the lock housing 11 on step.

Figure 5:
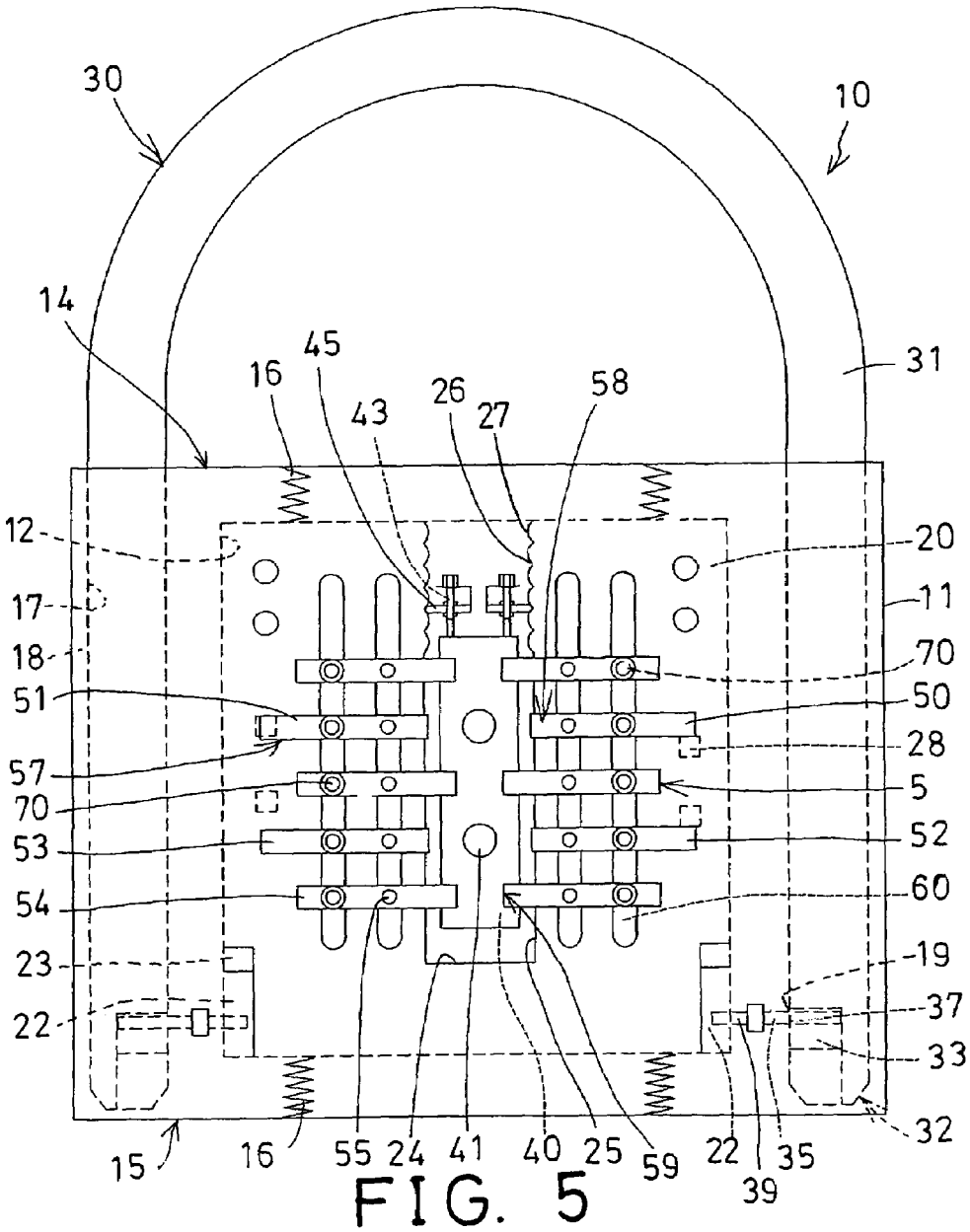
FIGS. 5, 6, 7 are top plan views similar to FIG. 2, illustrating the operation of the padlock.

As shown in FIG. 5, when the selected bar 51 of the selected indicium or numeral "3", for example, of the selected button 70 is then depressed by the user, the other selected bar 51 may actuate the selected protrusion 28 to move the carrier 20 relative to the lock housing 11 one more step.

Figure 6:
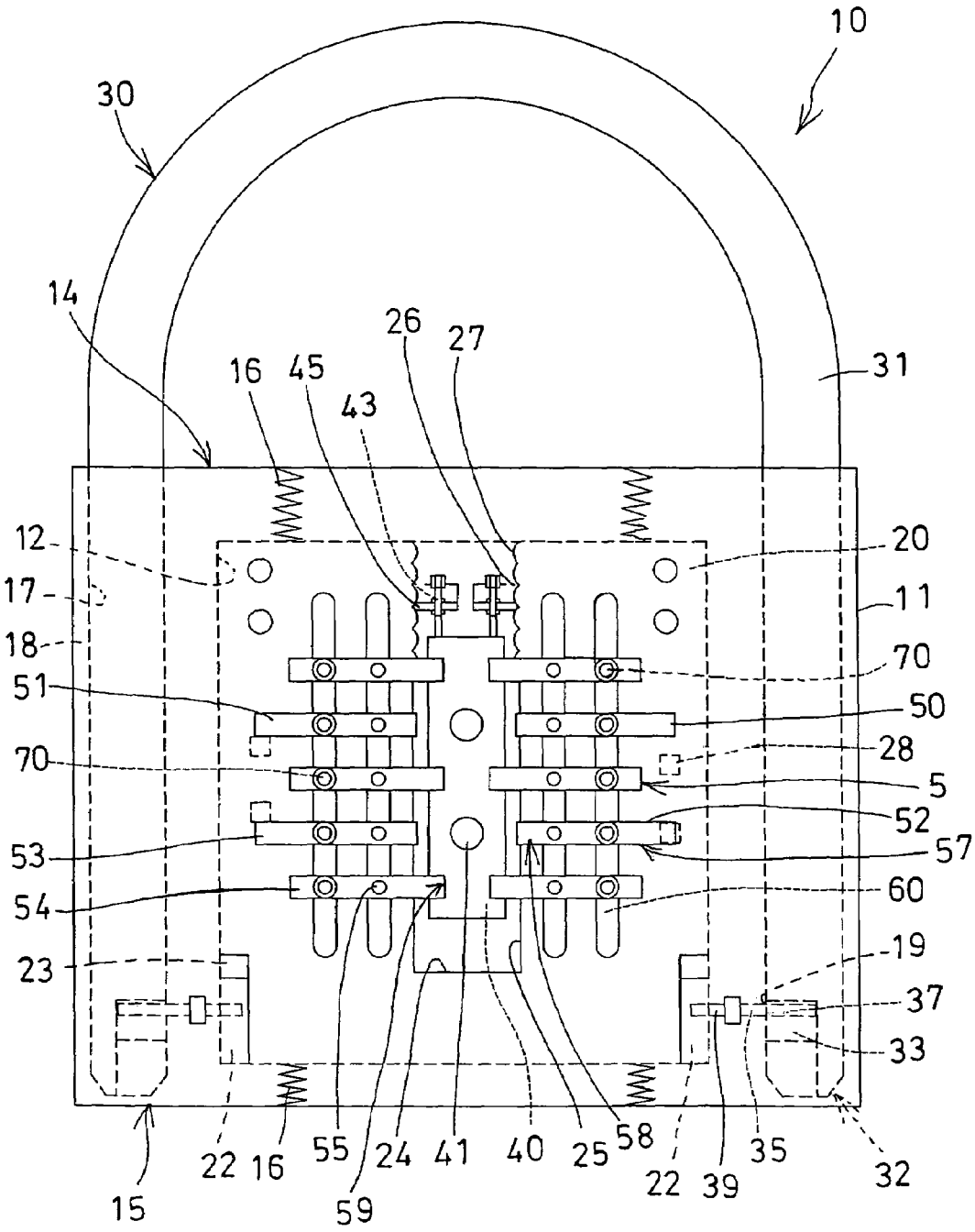

As shown in FIG. 6, when the selected bar 52 of the selected indicium or numeral "6", for example, of the selected button 70 is then depressed by the user, the further selected bar 52 may actuate the selected protrusion 28 to move the carrier 20 relative to the lock housing 11 one further step.

Figure 7:
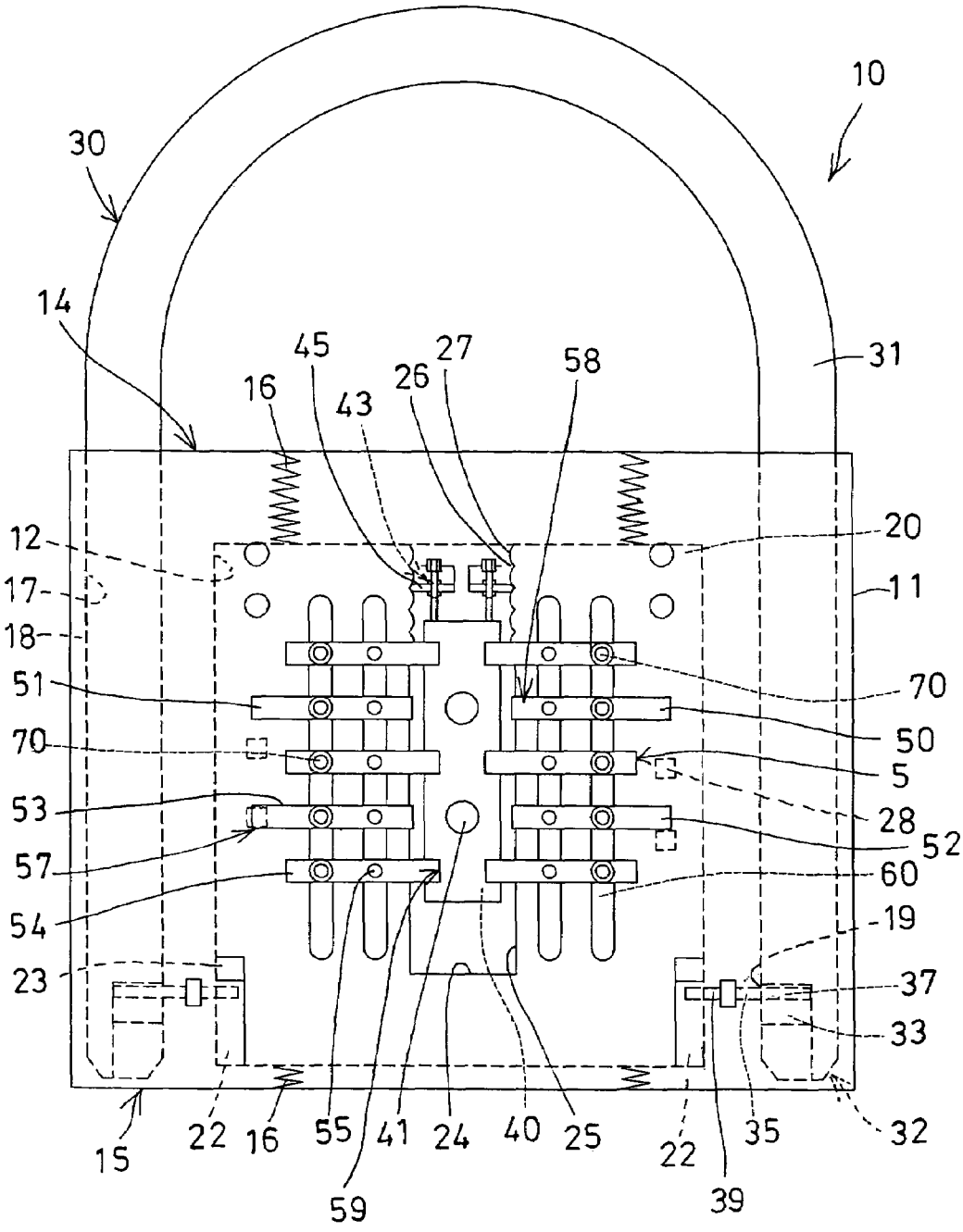

As shown in FIG. 7, when the further selected bar 53 of the selected indicium or numeral "7", for example, of the selected button 70 is then depressed by the user, the further selected bar 53 may actuate the further selected protrusion 28 to move the carrier 20 relative to the lock housing 11 one more step, and may force the actuating member 23 of the carrier 20 to actuate and to rotate the levers 35 relative to the lock housing 11 (FIG. 9), and thus to disengage the outer ends 37 of the levers 35 from the notches 33 of the legs 31 of the shackle 30, and to release the legs 31 of the shackle 30.

It is to be noted that the levers 35 may be actuated or moved by the actuating member 23 of the carrier 20 only when four of the selected bars 50, 51, 52, 53 and/or the selected buttons 70 are depressed or actuated by the users in series. For example, as shown in FIG. 5, the selected protrusion 28 may only be depressed or actuated by the selected bar 51 of the selected indicium or numeral "3" of the selected button 70 at this moment, and may not be depressed or actuated by the other selected and non-selected bars 50, 52–54 at this moment.

When either of the non-selected bars 54 is depressed or actuated by the users or unauthorized persons (FIG. 8), the follower 40 may be depressed and moved relative to the lock housing 11 and the carrier 20 by the non-selected bars 54, and the spring-biased tongues 45 of the anchoring devices 43 may also be disengaged from the depressions 26 of the carrier 20 by the follower 40, such that the carrier 20 is released and may be moved or recovered or restored or forced to move to the predetermined or required location or position within the chamber 12 of the lock housing 11 by the spring members 16.

It is to be noted that the protrusions 28 may be randomly arranged or disposed on the carrier 20 at the predetermined or required location or position, and arranged to be engaged with or actuated by the selected bars 50, 51, 52, 53, for allowing the carrier 20 to be moved relative to the lock housing 11 step by step by one or more selected bars 50, 51, 52, 53 in series.

Figure 10:
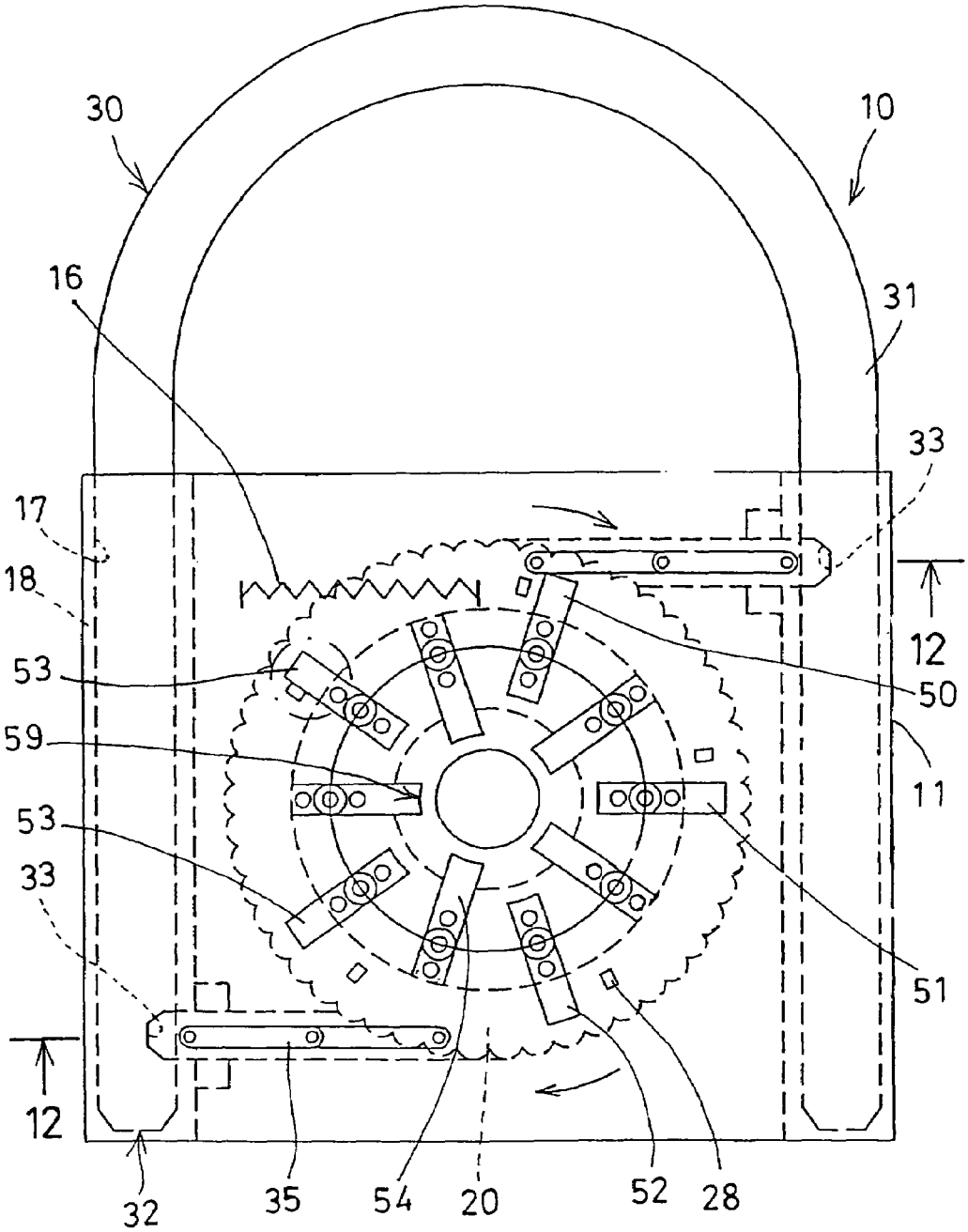
FIGS. 10, 11 are top plan views similar to FIGS. 2 and 5–7, illustrating the other arrangement of the padlock.
Figure 11:
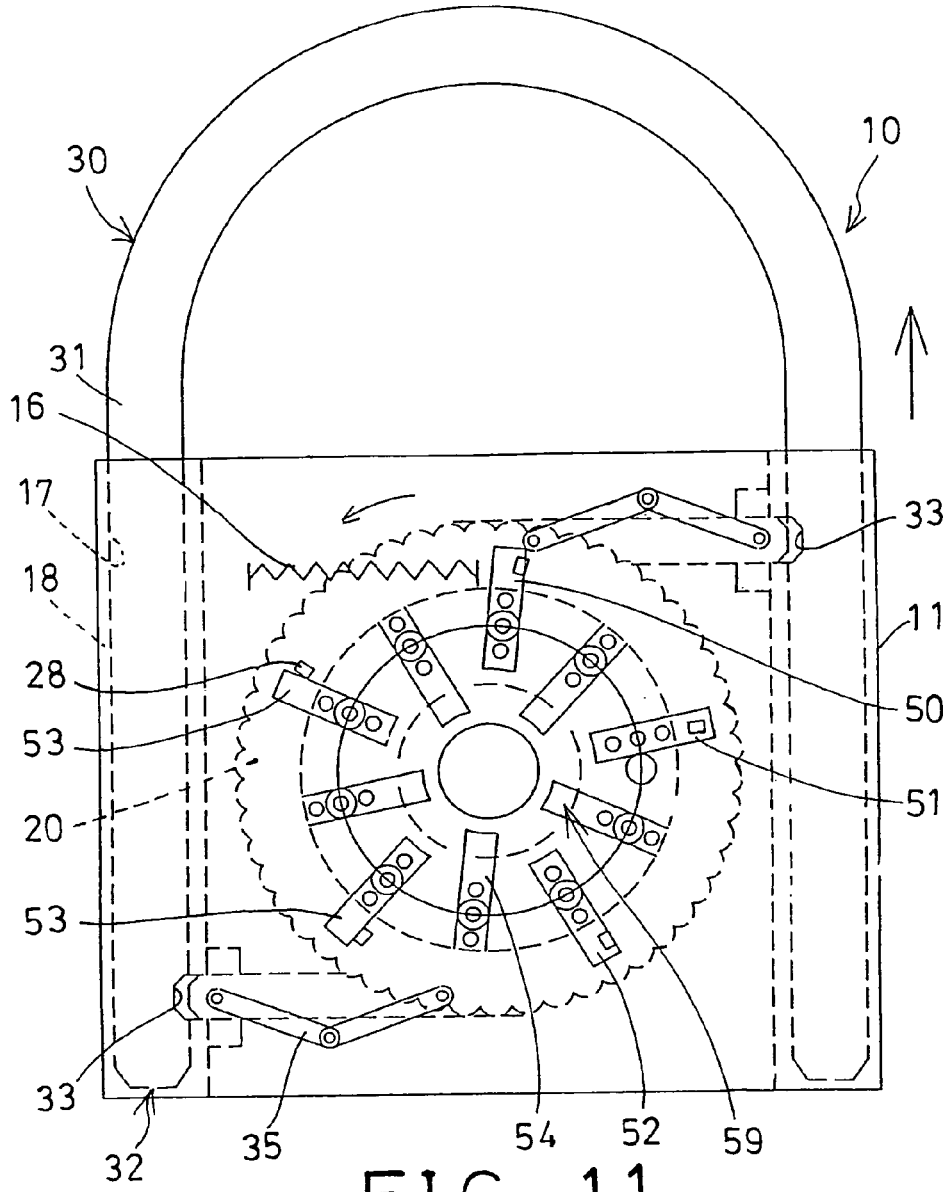
Figure 12:
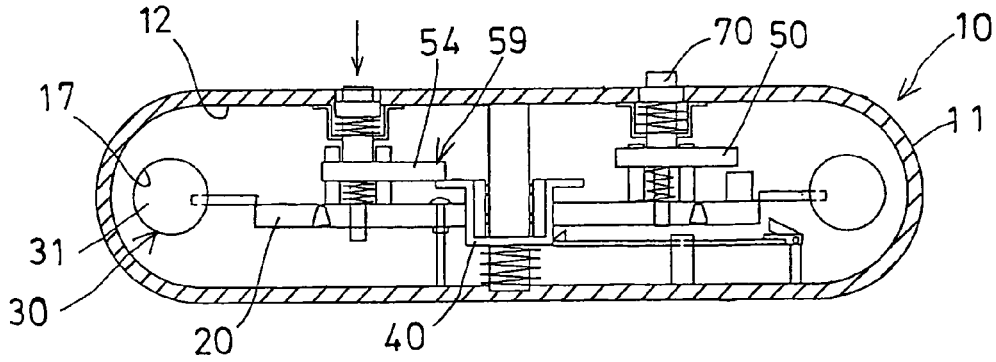
FIG. 12 is a partial cross sectional view of the padlock, taken along lines 12—12 of FIG. 10.

Alternatively, as shown in FIGS. 10–12, the carrier 20 may be rotatably received in the lock housing 11, and biased to required position by spring members 16, and has pivotally coupled levers 35 to engage with the legs 31 of the shackle 30, and a number of protrusions 28 actuatable by selected bars 50–53, and a number of non-selected bars 54 having ends 59 for actuating a follower 40 (FIG. 12).

Accordingly, the padlock in accordance with the present invention includes a restoring mechanism to restore the lock device back to original or initial status, and to prevent the padlock from being easily and quickly unlocked by unauthorized persons.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A padlock comprising:

a lock housing including a chamber formed therein, and including two longitudinal channels formed in side portions thereof, a shackle including two legs slidably engageable into said channels of said lock housing respectively, and each having a notch formed therein, a lever pivotally disposed in said lock housing with a pivot pin, and including a first end for engaging into said notch of either of said legs of said shackle, to anchor said legs of said shackle to said lock housing, and including a second end, a carrier slidably received in said chamber of said lock housing, and including an actuating member provided thereon, for selectively engaging with said second end of said lever, and for rotating said lever relative to said lock housing, to disengage said first end of said lever from said notch of said legs of said shackle, and to allow said legs of said shackle to be disengaged from said lock housing, said carrier including a plurality of protrusions extended therefrom, a spring biasing means for biasing said actuating member of said carrier away from said second end of said lever, a follower slidably attached onto said lock housing, and including an anchoring device for engaging with said carrier, and for positioning and anchoring said carrier to said lock housing at selected positions, an operating device including a plurality of selected bars and non-selected bars slidably attached onto said lock housing, said selected bars being arranged to engage with and to actuate said protrusions of said carrier, in order to move said carrier relative to said lock housing step by step, and said non-selected bars being arranged to engage with and to actuate said follower, to selectively disengage said anchoring device of said follower away from said carrier, and to allow said actuating member of said carrier to be biased away from said second end of said lever by said spring biasing means.

2. The padlock as claimed in claim 1, wherein said selected bars each includes an actuating end for engaging with said protrusions of said carrier, and for moving said carrier relative to said lock housing, and another end offset from said follower, to prevent said follower from being actuated by said selected bars.

3. The padlock as claimed in claim 1, wherein said non-selected bars are extended inwardly within a range of said follower, to allow said follower to be moved relative to said lock housing and said carrier by either of said non-selected bars, said non-selected bars are offset from said protrusions of said carrier, to prevent said protrusions of said carrier from being actuated by said non-selected bars.

4. The padlock as claimed in claim 1, wherein said lock housing includes a plurality of posts extended therefrom, said selected bars and said non-selected bars are slidably attached onto said posts of said lock housing.

5. The padlock as claimed in claim 4, wherein said lock housing includes a plurality of spring elements engaged onto said posts respectively, and engaged with said selected bars and said non-selected bars respectively, for biasing said selected bars and said non-selected bars away from said carrier and said follower respectively.

6. The padlock as claimed in claim 4, wherein said carrier includes a plurality of grooves formed therein, to slidably receive said posts, and to allow said carrier to be moved relative to said lock housing.

7. The padlock as claimed in claim 1, wherein said lock housing includes at least one rod extended therefrom, said follower is slidably attached onto said at least one rod of said lock housing, and movable toward and away from said carrier.

8. The padlock as claimed in claim 7, wherein said lock housing includes at least one spring element engaged with said at least one rod, and engaged with said follower, for biasing said follower away from said carrier.

9. The padlock as claimed in claim 1, wherein said lever includes means for forcing said first end thereof to engage into said notch of either of said legs of said shackle.

10. The padlock as claimed in claim 1, wherein said carrier includes a recess formed therein, and located to receive said second end of said lever, and said actuating member is arranged in said recess of said carrier.

11. The padlock as claimed in claim 1, wherein said lock housing includes two end portions, said spring biasing means includes at least two spring members disposed in said end portions of said lock housing, and engaged with said carrier, to bias and to resiliently move said carrier within said chamber of said lock housing.

12. The padlock as claimed in claim 1, wherein said carrier includes a space formed therein and defined between two side flanges each of which includes a plurality of depressions formed therein and defined between bulges, said anchoring device of said follower includes at least one tongue extended therefrom for engaging with said depressions of said carrier, and for anchoring said carrier to said follower and thus to said lock housing, and said at least one tongue of said anchoring device is disengageable from said depressions of said carrier when said follower is moved relative to said carrier.

13. The padlock as claimed in claim 1, wherein said lock housing includes a plurality of spring-biased buttons disposed therein, and each arranged in line with said selected bars and said non-selected bars respectively, for actuating said selected bars and said non-selected bars toward said carrier and said follower respectively.

14. The padlock as claimed in claim 1, wherein said lock housing includes two tubular members provided therein to define said longitudinal channels thereof, and to slidably receive said legs of said shackle therein respectively.

* * * * *